US005144382A

United States Patent [19]

Funayama et al.

[11] Patent Number: 5,144,382

[45] Date of Patent: Sep. 1, 1992

[54] DEVELOPING DEVICE WITH A SCRAPING UNIT ARRANGED TO FORM A STIRRING AREA

[75] Inventors: Naotaka Funayama, Yamato-Koriyama; Ikuo Itoh, Nara; Masatoshi Kaneshige, Ikoma; Toshiyuki Kurosaka, Kyoto, all of Japan

[73] Assignee: Sharp Kabushiki Kaisha, Osaka, Japan

[21] Appl. No.: 599,817

[22] Filed: Oct. 18, 1990

[30] Foreign Application Priority Data

Oct. 25, 1989 [JP] Japan ..... 1-279409
Oct. 30, 1989 [JP] Japan ..... 1-283643

[51] Int. Cl.[5] ..... G03G 15/09

[52] U.S. Cl. ..... 355/253; 118/657; 355/245

[58] Field of Search ..... 355/245, 246, 251, 253; 118/656, 657, 651

[56] References Cited

U.S. PATENT DOCUMENTS

| | | | |
|---|---|---|---|
| 4,089,297 | 5/1978 | Morita et al. | 118/651 X |
| 4,194,830 | 3/1980 | Ohnuma et al. | 355/245 |
| 4,365,586 | 12/1982 | Hosono et al. | 355/253 X |
| 4,559,899 | 12/1985 | Kan et al. | 355/253 X |
| 4,563,978 | 1/1986 | Nakamura et al. | 355/245 X |
| 4,676,192 | 6/1987 | Yuge et al. | 355/251 X |
| 4,814,820 | 3/1989 | Hirahara et al. | 118/657 X |
| 4,987,452 | 1/1991 | Nakagawa et al. | 355/245 |
| 4,993,829 | 2/1991 | Naganuma et al. | 355/251 |

FOREIGN PATENT DOCUMENTS

| | | | |
|---|---|---|---|
| 60-75854 | 4/1985 | Japan . | |
| 0095572 | 5/1985 | Japan | 355/253 |

*Primary Examiner*—A. T. Grimley
*Assistant Examiner*—Nestor R. Ramirez
*Attorney, Agent, or Firm*—David G. Conlin; Robert F. O'Connell

[57] ABSTRACT

The developing device, which is capable of mixing developers with magnetic toners and capable of providing the developers having a uniform magnetic toner density to a photoconductor for a copying machine, the device having a developing tank which contains a roller composed of a sleeve and a magnetic body with the magnetic body being disposed inside of the sleeve concentrically and rotatably with respect to each other, the device also having a magnetic toner supply tank disposed adjacent to the developing tank for supplying the magnetic toners to the developing tank through a toner supply port, the developing device includes a unit coupled to the developing tank for controlling an amount of the developers to be supplied to the sleeve, and a unit disposed between the toner supply port and the control unit for scraping the developers from the sleeve. The scraping unit is so arranged that a stirring portion is formed in association with the sleeve for stirring the developers scraped from the sleeve and the magnetic toners supplied from the toner supply tank through the toner supply port. The scaping unit has a throughhole for making the scraped developers to be mixed with the magnetic toners supplied from the toner supply tank through the toner supply port in accordance with a magnetic force produced by the magnetic body so as to produce a flow of the developers which passes through the throughhole.

16 Claims, 6 Drawing Sheets

DEVELOPING DEVICE WITH A SCRAPING UNIT ARRANGED TO FORM A STIRRING AREA

BACKGROUND OF THE INVENTION

1. Field of the Invention

The present invention relates to a developing device for a copying machine or a printer which employs an electrophotography.

2. Description of the Related Art

The inventors of the present invention know a developing device which includes a developing tank 12 disposed adjacent to a photoconductor 11 and a toner supply tank 14 for supplying magnetic toner 13 to the developing tank 12, a separating plate 15 disposed between the developing tank 12 and the toner supply tank 14, and a toner supply port 16 formed below the separating plate 15 for connecting the developing tank 12 and the toner supply tank 14 to each other, as shown in FIG. 1.

The developing tank 12 is composed of a developing roller 18 rotatably supported by a developing device body 17 and a doctor 20 for restricting the amount of developers (the toner and a carrier) 19 which are attracted to a surface of the developing roller 18. As shown in FIG. 2, the developing roller 18 includes a sleeve 21 which rotates in the reverse direction to the direction of rotation of the photoconductor 11 and a magnetic body 22 disposed on the inner surface of the sleeve 21, the magnetic body 22 being arranged to rotate in the reverse direction to the direction cf rotation of the sleeve 21.

The toner supply tank 14 includes a toner stirring roller 23 rotatably disposed so as to stir and supply a magnetic toner 13 to the developing tank 12 through the toner supply port 16.

As a result of the above-described structure, the developers (the toner and the carrier) 19 enclosed in the developing tank 12 are moved by a rotation of the sleeve 21 and that of the magnetic body 22 with the amount of the developers on the surface of the sleeve 21 restricted by the doctor 20. The developers 19 are further moved until to reach the photoconductor 11 so that an image is developed.

Furthermore, two-component developing devices which use the magnetic toner are disclosed in Japanese patent application Laying Open No. 60-75854, No. 62-5279, No. 63-6572, No. 63-83753 and No. 63-129366.

However, in any one of the above-mentioned developing devices, the developers including the magnetic toners and the carriers encounter a problem in that the magnetic toners supplied from the toner supply tank and the developers cannot be satisfactorily stirred. Furthermore, the pressure and the fluidity of the developers in a stirring chamber or the circulating passage are changed due to the deterioration in the developers and to the humidity as well as the temperature. As a result, another problem arises in that the toner density in the developers becomes too unstable.

In general, the development is performed by each of the printers in accordance with the inverse developing method. In the case where a solid black pattern (the ratio of a black portion and a white portion is 100%) is printed after the originals 24 and 25 respectively shown in FIGS. 3 and 4 were successively printed in 200 paper sheets, then the documents 26 and 27 shown in FIGS. 5 and 6 respectively are obtained. As a result, partial solid white portions 28, 29 are formed in the portions in which there is no image, while the image portions are free from the solid white portions 28, 29.

A comparison is made between the amount of the charge of the magnetic toners on the sleeve of the developing roller at the positions which correspond to the non-image portions in which the solid-white portions 28, 29 are formed and that at the positions which correspond to the image portions in which no solid-white portions 28, 29 are formed. As a result, it is found that the amount of the charge of the magnetic toners at the positions corresponding to the non-image portions are lower than the other portions. It might be considered that the reason for this lies in a fact that an electric influence on the image portions and that on the non-image portions are different from each other at a time when the portions contact with the photoconductor 11.

Therefore, the developers on the sleeve in the non-image portions are always in contact with portions of the photoconductor 11 in which the electrical potential is high (it is usually 400 V or higher). As a result, the charge of the developers is discharged, causing the amount of charge of the magnetic toners to be reduced. It leads to a fact that the amount of the magnetic toners to be transferred to the photoconductor 11 is reduced. Therefore, the density of the image in the solid-black portions is undesirably lowered.

Furthermore, any one of the above-described developing devices encounters a problem in that the developers are, by falls or vibrations, moved to either side in the axial direction of the developing roller during the transportation of the developing tank from a manufacturing plant to a user when the developing tank is filled with the developers at the manufacturing plant. Therefore, when the magnetic toners introduced into the toner supply tank are supplied to the developing tank, the magnetic toner density becomes different in the axial direction, and as a result the image density differs in the axial direction.

SUMMARY OF THE INVENTION

It is therefore an object of the present invention to provide a developing device which is capable of supplying developers having a uniform density of magnetic toners to a photoconductor used for a copying machine, and which is also capable of preventing the movement of the developers in the developing tank to either side due to falls or vibrations during the transportation so that the magnetic toner density of the developers in the axial direction is made a uniform and a stable.

The object of the present invention can be achieved by a developing device, which is capable of mixing developers with magnetic toners and capable of providing the developers having a uniform magnetic toner density to a photoconductor for a copying machine, the device having a developing tank which contains a roller composed of a sleeve and a magnetic body with the magnetic body being disposed inside of the sleeve concentrically and rotatably with respect to each other, the device also having a magnetic toner supply tank disposed adjacent to the developing tank for supplying the magnetic toners to the developing tank through a toner supply port, the developing device includes a unit coupled to the developing tank for controlling an amount of the developers to be supplied to the sleeve, and a unit disposed between the toner supply port and the control unit for scraping the developers from the sleeve, the scraping unit being so arranged that a stirring portion is formed in association with the sleeve for stirring the developers scraped from the sleeve and the magnetic toner supplied from the toner supply tank through the toner supply port.

Preferably, the scraping unit is so arranged that another stirring portion is formed between the scraping unit and the control unit for stirring the developers controlled by the control unit so that a circulating flow of the developers flows toward the stirring unit.

More preferably, the scraping unit has a throughhole for making the scraped developers to be mixed with the magnetic toners supplied from the toner supply tank through the toner supply port in accordance with a magnetic force produced by the magnetic body so as to produce a flow of the developers which passes through the throughhole.

Further preferably, the scraping unit is a flat plate having a L shape cross section with one of end parts thereof being a scraping part which is bent in a direction toward the developing roller for scraping the developers from the sleeve.

The scraping part is preferably positioned in a lower stream from the toner supply port in a rotational direction of the sleeve and close to the control unit.

The other one of the end parts of the flat plate is preferably bent in parallel with the one of end parts so as to be fastened to a part of the device disposed below the toner supply port.

Preferably, a distance d between the scraping part and the control unit is so arranged that the distance d satisfies a relation of $e \leqq d \leqq 1.0$ mm with the e representing a distance between the control unit and the sleeve.

The distance d is in a range of $0.7 \pm 0.1$ mm with the distance e being in a range of $0.3 \pm 0.02$ mm.

The device further includes a unit coupled with the magnetic toner supply tank for stirring the magnetic toner, the stirring unit having a urging unit coupled with one of end parts thereof for pushing the magnetic toner against the developers at the toner supply port so as to mix the magnetic toners with the developers.

Preferably, the stirring unit has a crashing unit coupled with the other one of end parts thereof for crashing a solidified part of the developers at the toner supply port.

The urging unit and the crashing unit are preferably capable of applying pressures to the magnetic toner every half revolution of the stirring unit so that the magnetic toners are sent under a pressure and supplied in a wavelike manner to the toner supply port.

Further preferably, a revolution of the sleeve is arranged to be 60 rpm, a revolution of the magnetic body is arranged to be 500 rpm with a distance between the photoconductor and the sleeve being 0.35 mm.

The device further includes a unit disposed between the scraping unit and the control unit for accommodating the developers to be mixed with the magnetic toners.

Preferably, the accommodation unit is capable of accommodating an amount of the developers which is 1.3 times of a normal amount of the developers before using the developing tank.

Further preferably, the stirring unit has a support plate and the device body has a roller shaft rotatably supported by the device body, the support plate being fixed to the roller shaft.

One of end parts of the support plate is preferably adapted to fasten the urging unit in a direction perpendicular to the support plate so as to send the magnetic toners in contact with a bottom surface of the developing tank elastically.

The other one of the end parts of the support plate is preferably adapted to fasten the crashing unit, the crashing unit including a coil spring fixed to two end parts of the roller shaft and disposed in parallel to the roller shaft so as to prevent the magnetic toners to be solidified by vibrating the magnetic toners.

According to the above-mentioned developing device of the present invention, the developers, which are subjected to the developing process but are not transferred to the photoconductor, are attracted to the sleeve before scraping off by the scraping part. The scraped developers are stopped by the scraping unit and a flow of the developers is generated due to the rotation of the magnetic body.

The magnetic toners which are sent from the toner supply tank to the toner supply port is attracted by the magnetic force of the magnetic body so that the developers and the magnetic toners are stirred and mixed with each other by the above-described flow. As a result, the magnetic toner density can be made to a predetermined value. The developers sufficiently stirred by the first stirring unit pass between the scraping part and the sleeve due to the rotation of the sleeve and that of the magnetic body. As a result, the developers reach the control unit at which the amount of the developers is controlled before sending to the photoconductor. On the other hand, the developers, the amount of which is controlled by the control unit and scraped by the scraping part, are circulated to the second stirring unit, and the developers are stirred again in accordance with a magnetic force produced by rotating the magnetic body.

Therefore, the developers containing the magnetic toners can be sufficiently stirred and mixed with the magnetic toner.

The developers, the amount of which is restricted by the control unit and scraped off from the sleeve, forms a circulating flow moving toward the scraping unit so as to join another circulating flow before the developers are stirred again.

Since the flow (the circulating flow) of the developers efficiently sends the developers due to the magnetic force of the developing roller and the rotation of the sleeve, no space is substantially formed in the upper region of the second stirring unit and the second stirring unit is filled with the developers (no empty space). As a result, the volume of the developers cannot be easily changed, causing the magnetic toner density to be stabilized. Furthermore, the developer is further scraped off by the scraping unit so as to generate the circulating flow. As a result, the circulating flow is allowed to join the circulating flow generated in the first stirring unit. Therefore, the performance for stirring the developers can be improved. In addition, since the position of the scraping unit is adjacent to the toner supply port, the supplied magnetic toner can be sufficiently stirred and mixed.

The urging unit and the crashing unit apply pressure to the magnetic toner every half rotation of the stirring unit so that the magnetic toner is sent and supplied in a wave-like manner to the toner supply port. If a solidified part is contained in the pressurized developers which is allowed to join the other circulating flow, the crashing unit crashes solidified developers. The urging unit sends the magnetic toners in the toner supply tank to the toner supply port so as to push the magnetic toners in the wave-like manner against the flow of the developers allowed to join and circulated. As a result, the stirring and the mixing can be efficiently performed.

As a result, the magnetic toners can be uniformly mixed with the developers so that the charging characteristics of the magnetic toners are improved. Furthermore, the magnetic toner density of the developers can be stabilized. Therefore, the necessity of the provision of the stirring roller and the toner density sensor for the developing tank can be eliminated. As a result, the size of the developing tank can be reduced.

The developers are charged in the developing tank by a developer charger with the moving side of the developing roller allowed to face downwards and as well vibrating the developing tank.

The developing device to which the developers are charged is delivered from the manufacturing plant to a user so as to be fastened to a copying machine.

The developing tank is vibrated during the abovedescribed transportation, causing the developers to move to either side in the accommodation unit. However, the density of the developers in the accommodation unit can be raised by making the amount of the developers to be charged in the accommodation unit to be 1.3 times or more the usual amount. Therefore, the developers cannot be easily moved.

As a result, the generation of undesired spaces in the accommodation unit due to the movement of the developers to either side caused from falls or vibrations during the above-described transportation can be prevented. Furthermore, the axial difference in the magnetic toner density after the magnetic toners are injected can be reduced. Consequently, the difference in the image density can be prevented.

Further objects and advantages of the present invention will be apparent from the following description, reference being had to the accompanying drawings wherein preferred embodiments of the present invention are clearly shown.

DESCRIPTION OF THE PREFERRED EMBODIMENTS

Figure 1:
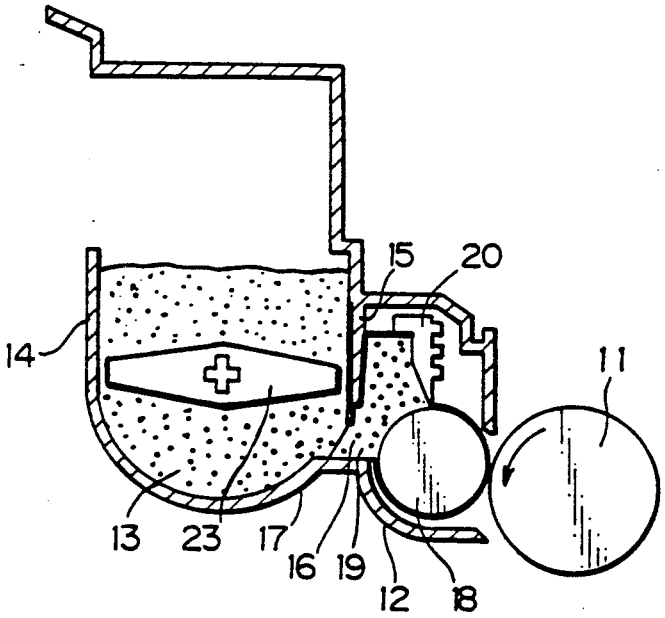
Fig. 1 PRIOR ART
FIG. 1 illustrates an example of the structure of a known developing device.
Figure 2:
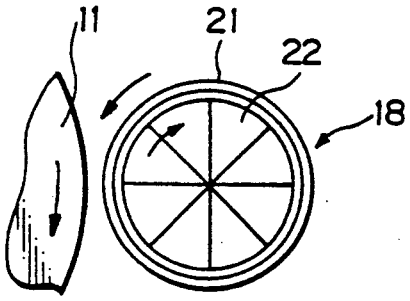
FIG. 2 illustrates the relative rotational directions of the developing roller and the photoconductor shown in FIG. 1.
Figure 3:
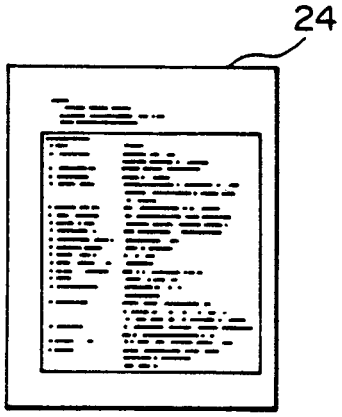
FIG. 3 illustrates an example of a document pattern printed by the known developing device shown in FIG. 1.
Figure 4:
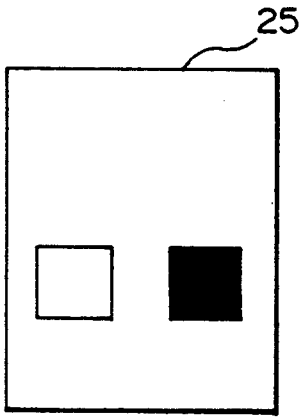
FIG. 4 illustrates another example of a document pattern printed by the known developing device shown in FIG. 1.
Figure 5:
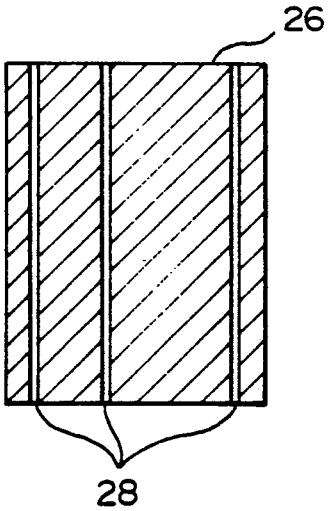
FIG. 5 illustrates an example of a document pattern developed by an inverse manner by the known developing device shown in FIG. 1.
Figure 6:
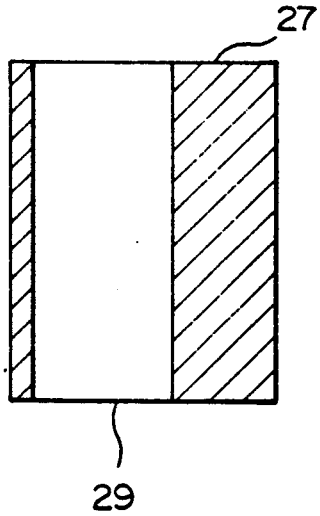
FIG. 6 illustrates another example of a document pattern developed by an inverse manner by the known developing device shown in FIG. 1.
Figure 7:
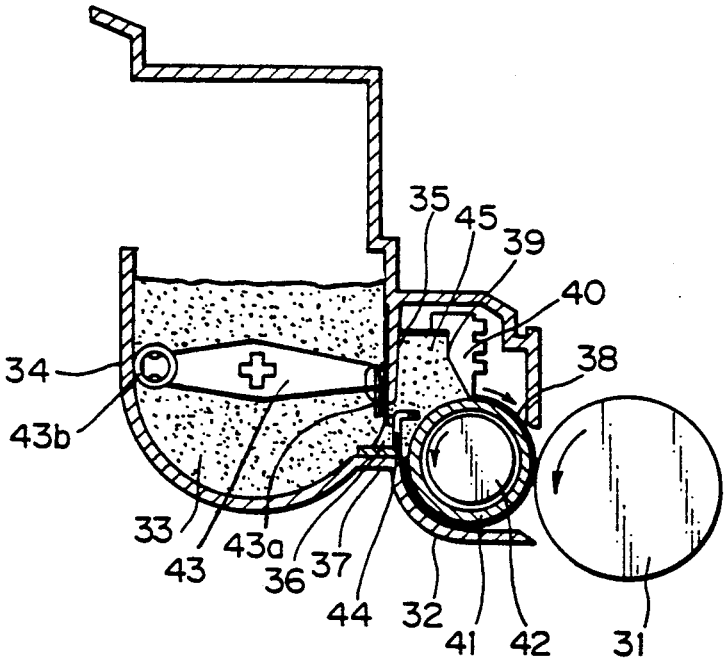
FIG. 7 illustrates an example of the structure of an embodiment of a developing device according to the present invention.
Figure 8:
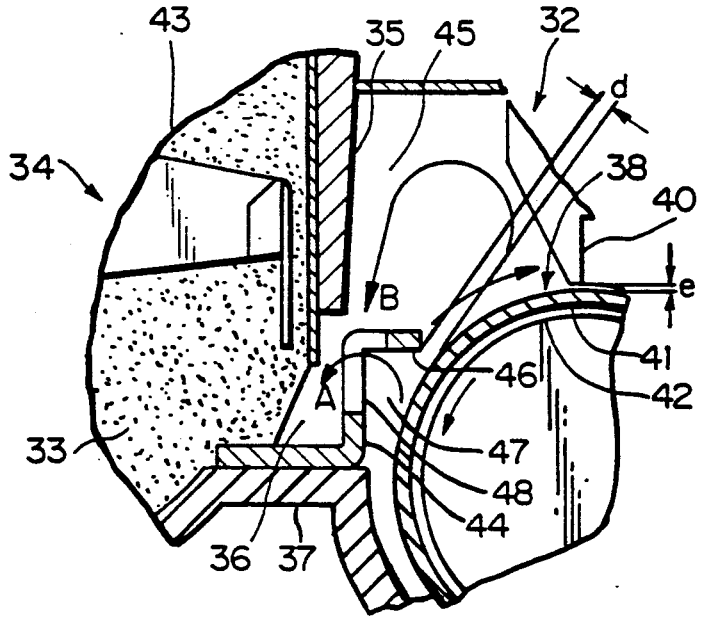
FIG. 8 is an enlarged view which illustrates an essential portion of the developing device shown in FIG. 7.

An embodiment of the present invention will now be described with reference to the drawings. FIG. 7 is a cross sectional view which illustrates an embodiment of a developing device according to the present invention. FIG. 8 is an enlarged view which illustrates an essential parts of the developing device shown in FIG. 7.

As shown in FIGS. 7 and 8, the developing device according to the present invention includes a developing tank 32 having a developing roller 38 which is composed of a sleeve 41 and a magnetic body 42 which are rotatably disposed with respect to each other. The developing device further includes a toner supply tank 34 for supplying a magnetic toner 33 to the developing tank 32. The developing tank 32 is provided with a doctor 40 as a control unit for controlling and restricting the amount of developers 39 on the surface of the sleeve 41. Furthermore, a scraping member 44 as a scraping unit for scraping the developers 39 on the surface of the sleeve 41 is disposed between a toner supply port 36 for supplying the magnetic toners 33 from the toner supply tank 34 to the developing tank 32 and the doctor 40. The scraping member 44 is disposed adjacent to the developing roller 38. In addition, a first stirring portion 47, which stirs and mixes the developers 39 scraped by the scraping member 44 and the supplied magnetic toner 33, is provided in order to make the magnetic toner density of the developers 39 to be uniform.

A second stirring portion 45 is disposed between the scraping member 44 and the doctor 40 for stirring the developers 39, the amount of which has been restricted by the doctor 40, and moving the developers 39 toward the first stirring portion 47.

The scraping member 44 is disposed adjacent to the toner supply port 36 for mixing the developers 39 moved by the second stirring portion 45 with the developers 39 which are scraped by the scraping member 44.

A toner stirring roller 43 for introducing the magnetic toners 33 into the developing tank 32 is included in the toner supply tank 34. The toner stirring roller 43 as a stirring unit is provided with an urging unit 43*a* for bringing the magnetic toners 33 into contact with the developers 39 at the toner supply port 36 and a crashing unit 43*b* for crashing the developers 39 which is solidified due to the above-described contact at the toner supply port 36.

The magnetic toners 33 contains magnetic ferrous oxide, so that the developers 39 are produced by mixing the carriers containing ferrite, iron dust or magnetic ferrous oxide granulated carriers and the magnetic toners 33 as well.

The scraping member 44 is in the form of a flat plate having an L-shape cross section. The scraping member 44 is arranged so that an end portion of the scraping member 44 bent in the direction of the developing roller 38 serves as a scraping part 46. Another end portion of the scraping member 44 is bent in parallel with the scraping part 46 so that scraping member 44 is fastened to a developing device body 37 which is disposed below the toner supply port 36.

A scraping part 46 is formed in the scraping member 44 for making the toner density of the developer 39 to be uniform by mixing and stirring the scraped developer 39 and the supplied magnetic toner 33.

The scraping part 46 is positioned in the lower stream from the toner supply port 36 in the direction of rotation of the sleeve 41 and in front of the doctor 40. The distance d between the scraping part 46 and the sleeve 41 is arranged to be $e \leqq d \leqq 1.0$ mm assuming that the distance from the doctor 40 to the sleeve 41 is e. According to this embodiment, the values of d and e are set to be $d=0.7\pm0.1$ mm and $e=0.3\pm0.02$ mm.

The first stirring portion 47 is defined by the opening 48, the scraping part 46 and the sleeve 41. The opening 48 is formed in the scraping member 44 in order to connect the toner supply port 36 and the developing roller 38 each other.

As shown in FIG. 8, the developers 39, which are scraped from the surface of the sleeve 41 by the scraping part 46, generates a circulating flow A due to the rotation of the magnetic body 42. As a result of the generated flow A, the magnetic toners 33 are attracted by the magnetic force of the magnetic body 42 from the toner supply port 36 through the opening 48, and as a consequence the developers 39 are stirred and mixed with each other.

The second stirring portion 45 is defined by a part which is surrounded by the doctor 40, the sleeve 41 and a separating plate 35. The developers 39, the amount of which is restricted by the doctor 40, are allowed to flow by the developers 39 which are moved on the surface of the sleeve 41 due to the magnetic force of the magnetic body 42 and the rotation of the sleeve 41. As a result, a circulating flow B flowing toward the scraping member 44 is generated.

The revolution of the sleeve 41 is arranged to be 60 rpm, that of the magnetic body 42 is arranged to be 500 rpm and the distance from the photoconductor 31 to the sleeve 41 is arranged to be 0.35 mm.

The developers 39 are magnetically attracted to the surface of the sleeve 41 of the developing roller 38 in a standing manner due to the rotation of the sleeve 41 and the magnetic body 42. Then, the amount of the attraction of the developers is restricted by the doctor 40 before supplying to the photoconductor 31, so that the developers 39 having a uniform magnetic toner density are transferred to the photoconductor 31 and the development is performed.

As a result, the developers 39, which are subjected to the developing process but is not transferred to the photoconductor 31, are attracted to the surface of the sleeve 41 before it is scrape by the scraping part 46. The movement of the scraped developers 39 are stopped by the scraping part 46, and the circulating flow A flowing toward the opening 48 is generated due to the rotation of the magnetic body 42.

In the toner supply tank 34, the urging unit **43*a* and the crashing unit 43*b* apply pressure to the magnetic toner 33 every half revolution of the toner stirring roller 43 so that the magnetic toners 33 are sent under a pressure and is supplied in a wave-like manner to the toner supply port 36. In a case where solid bodies presented in pressurized developers 39 which are formed by circulating a joint flow of the magnetic toner 33, the circulating flow A, and the circulating flow B, then the crashing part 43*b* crashes the solid bodies. The urging part 43*a* sends the magnetic toners 33, which are contained in the toner supply tank 34, to the toner supply port 36 in order to push the magnetic toners 33 against the circulated flow of the developers 39 formed by the above-described joining. As a result, the mixture and the stirring of the magnetic toners 33 and the developers 39** are efficiently performed.

The developers 39, which are stirred and mixed with the magnetic toners 33 at the toner supply port 36, passes through the lower portion of the opening 48 formed in the scraping member 44 by the magnetic force of the developing roller 38 and the moving force of the sleeve 41. As a result, the developers 39 flows toward the sleeve 41.

In a case where the magnetic toner density is too low at the first stirring portion 47, the magnetic toners 33 supplied to the toner supply port 36 by the toner stirring roller 43 of the toner supply tank 34 is attracted by the magnetic force of the magnetic body 42 so that the developers 39 and the magnetic toners 33 are stirred by the circulating flow A. As a result, the magnetic toner density is made to be a predetermined value.

The developers 39, which are sufficiently stirred by the first stirring unit 47 is caused to pass between the scraping unit 46 and the sleeve 41 due to the rotation of the sleeve 41 and that of the magnetic body 42 so that the developers 39 are supplied to the doctor 40. A portion of the developers 39 passes between the doctor 40 and the sleeve 41 so that the amount of the attraction of the developers 39 is restricted before supplying to the photoconductor 31. On the other hand, the developers 39 restricted and scraped off by the doctor 40 generate a flow designated by the circulating flow B which flows toward the scraping member 44 before stirring again by the circulating flow A.

As a result of the flow of the developers 39 designated by the circulating flow B, the developers 39 are efficiently sent by the magnetic force of the developing roller 38 and the rotation of the sleeve 41. Therefore, no space is formed in the upper portion of the region defined in cooperation with the second stirring portion 45 and the region is filled with the flowing developers 39 under pressure. The developers 39 (the circulating flow B) which are counterclockwise passed in the second stirring portion 45 meet and join the flow of the developers 39 (the circulating flow A) which are scraped off by the scraping member 44 so that the developer flow to the toner supply port 36.

Therefore, the developers 39 (which contains the magnetic toners 33 and the carriers) and the magnetic toners 33 can be sufficiently stirred by rotating the magnetic body 42, by scraping off the developers 39 from the sleeve 41 by the action of the scraping member 44 and by forming the first stirring portion 47. As a result, the magnetic toners 33, which are stirred and mixed with the developers 39, can be sent to the photoconductor 31. As a result, the charging characteristics of the developers 39 can be improved and the magnetic toner density of the developers 39 can be stabilized. Therefore, a generation of the white portion can be prevented in the inverse developing method.

Furthermore, a developing device having an automatic toner density stabilizing mechanism, which is able to satisfactorily operate regardless of the amount of the magnetic toners 33 in the toner supply tank 34 and the change in the fluidity of the magnetic toner 33 and that of the developers 39 due to the temperature and the humidity, can be realized, and as a consequence, the necessity of the provision of the stirring roller and the toner density sensor for the developing tank 32 can be eliminated. As a result, the size and the overall cost of the developing device can be reduced.

Furthermore, since the second stirring portion 45 is formed, the portion between the separation plate 35 and the doctor 40 is filled with the developers 39 (there is no space), the volume of the developers 39 cannot be easily changed. Therefore, the magnetic toner density can be stabilized. In addition, the developers 39 are further scraped off by the doctor 40 and the circulating flow is thereby generated. Therefore, the thus generated circulating flow is allowed to join the circulating flow generated in the first stirring portion 47. As a result, the performance of stirring the developers 39 can be improved. Furthermore, since the scraping member 44 is disposed adjacent to the toner supply port 36, the supplied magnetic toner 33 can be efficiently mixed and stirred.

In addition, since the urging portion 43*a* and the crashing portion 43*b* are provided for the toner stirring roller 43, the magnetic toner 33 can be satisfactorily stirred and mixed with the developers 39 in the first stirring portion 47.

Furthermore, a seal member 49 made of polyethylene telephthalate (PET) is positioned above the developing roller 38 when the developing tank 32 is assembled, and the seal member 49 is arranged in such a manner that it extends from the doctor 40, passes above the scraping member 44, contacts with the separation plate 35, passes through the toner supply port 36 and reaches the upper portion of the toner supply tank 34. In addition, a cushion member 50 made of polyurethane foam and in the form of a trapezoid is inserted into the toner supply port 36 for the purpose of making the seal member 49 in contact with the separation plate 35.

Figure 9:
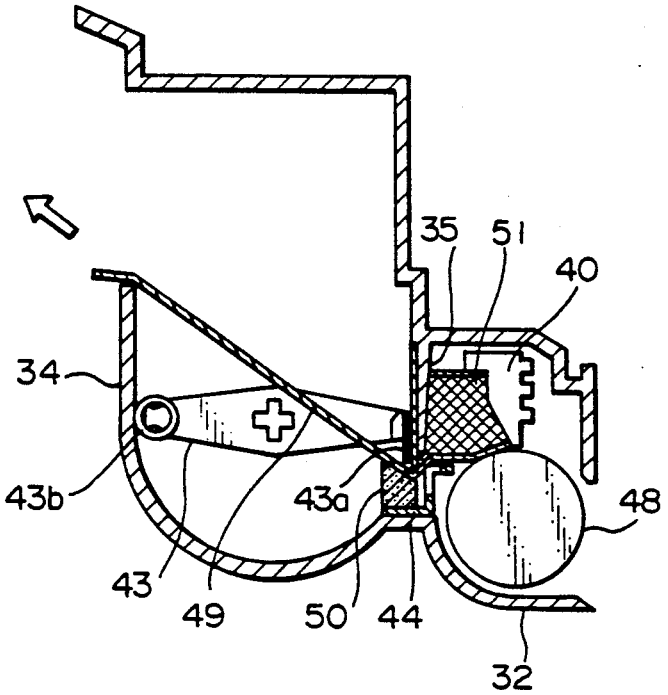
FIG. 9 illustrates the developing device shown in FIG. 7 and in a state where the developer is charged.
Figure 10:
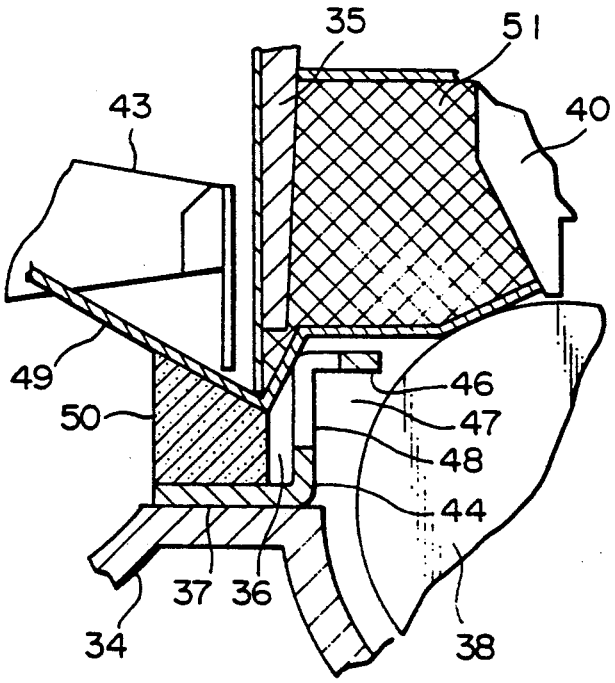
FIG. 10 illustrates the essential portion of the developing device shown in FIG. 7 and in a state where the developer is charged.
Figure 11A:
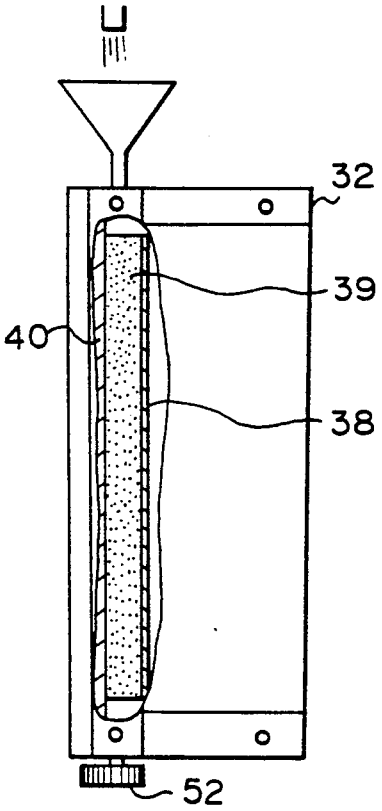
FIGS. 11*a*–14*b* illustrate a portion of the developing tank in states with various amounts of the developers at a time when the developing tank is vibrated after injecting the developers to the developing tank of the developing device shown in FIG. 7.

Another embodiment of the developing device according to the present invention is shown in FIGS. 9 and 10.

In FIGS. 9, 10, the same elements in the previous embodiment are shown with the same numerals and the details of these elements are omitted in the following description unless necessary.

This embodiment of the developing device according to the present invention, as shown in FIGS. 9 and 10 includes a accommodation unit 51 disposed between the scraping member 44 and the doctor 40. When the developing tank 32 is in a state before the use, the accommodation unit 51 is filled with the developers 39 by the amount which is 1.3 times of the normal quantity by weight.

The toner stirring roller 43 has a support plate 50 fixed to a roller shaft (not shown) rotatably supported by the developing device body. The urging unit 43*a* is fastened to an end part of the support plate 50, while the crashing unit 43*b* is fastened to another end part of the support plate 50.

The urging unit 43*a* is made of a resin plate fastened in a direction perpendicular to the support plate 50 so as to send the magnetic toners 33 in contact with the bottom surface of the toner supply tank 34 elastically.

The crashing unit 43*b* includes a coil spring fixed to the two end portions of the roller shaft (not shown) and disposed in parallel to the roller shaft (not shown) so as to prevent the magnetic toners 33 from solidification by vibrating the magnetic toners 33.

The above-described accommodation unit 51 is defined by a space surrounded by the seal member 49, the doctor 40 and the separation plate 35 and along the axial direction of the developing roller 38. The seal member 49 is fastened for the purpose of preventing the leakage of the developers 39. The capacity of the accommodation unit 51 is arranged to be 28.5 $cm^3$.

The revolution of the sleeve 41 is arranged to be 60 rpm, that of the magnetic body 42 is arranged to be 500 rpm and the distance from the photoconductor 31 to the sleeve 41 is arranged to be 0.35 mm. Referring to FIGS. 11*a*–14*b*, reference numeral 52 represents a developing-roller rotating gear.

The seal member 49 is fastened at the time of the assembling of the developing tank 32 in such a manner that the seal member 49 extends from the doctor 40, passes above the scraping member 44 and contacts with the separation plate 35 above the toner supply port 36. The accommodation unit 51 is formed by sectioning the developing tank 32.

The developers 39 are charged from the follower side of the developing roller 38 by a developer charger with allowing the operating side of the developing roller 38 to face downwards and as well vibrating the developing tank 32.

The developing device, to which the developers 39 are charged, is delivered from the manufacturing plant to the user so as to be fastened to the copying machine.

During the above-described transportation, the developing tank 32 is vibrated, causing the developers 39 to move to either side of the accommodation unit 51.

Therefore, the state of the developers 39 in the accommodation unit 51 when the developers 39 are moved to either side of the accommodation unit 51 due to the vibration applied after the developers 39 are charged will be described.

The capacity of the accommodation unit 51 of the developing tank 32 is 28.5 $cm^3$ and the apparent density of the developers 39 to be charged is 1.23 $g/cm^3$. Therefore, the normal discharge amount by weight becomes $28.5 \times 1.23 = 35$ g.

Figure 12A:
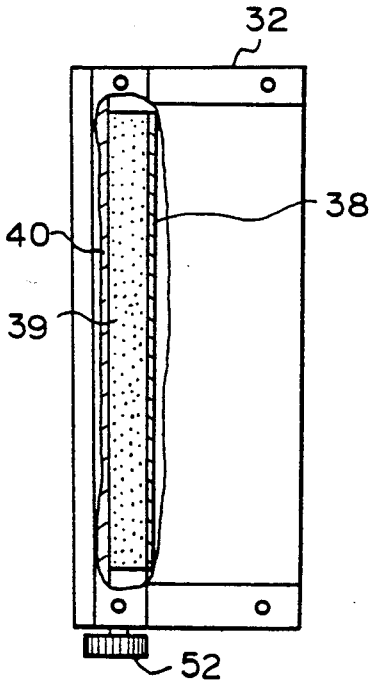
Figure 11B:
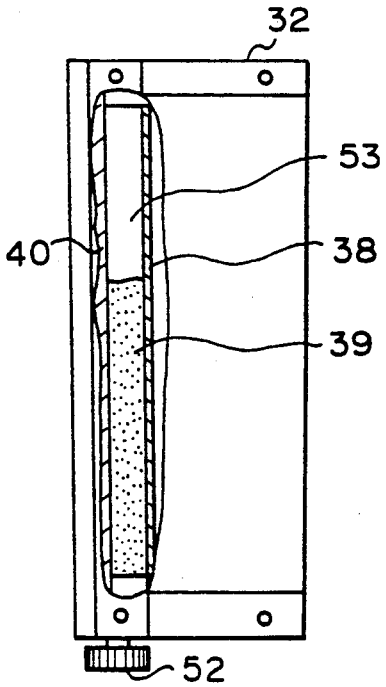
Figure 12B:
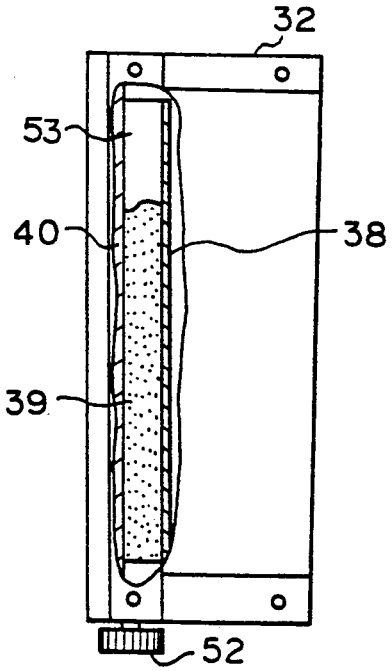
Figure 13A:
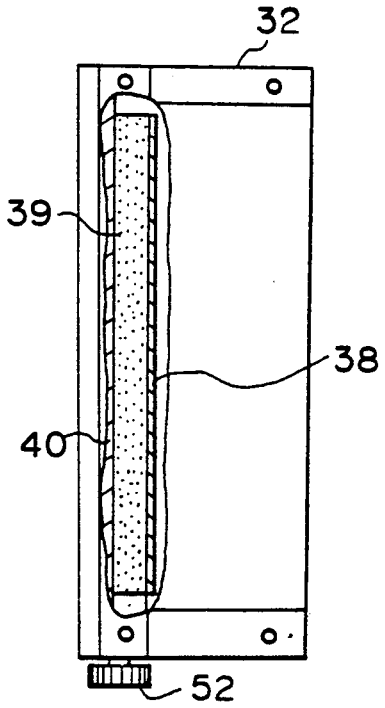
Figure 14A:
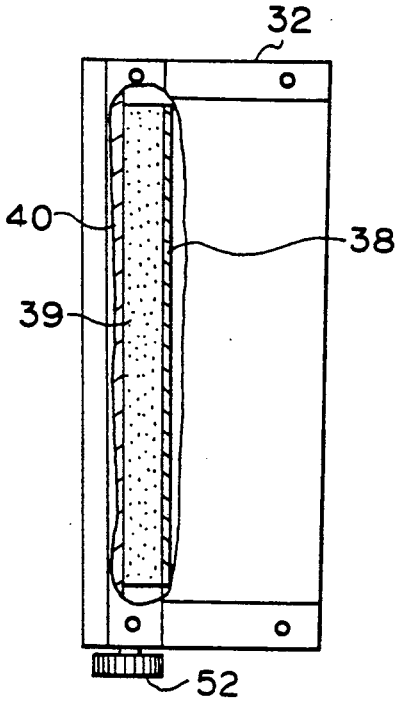
Figure 13B:
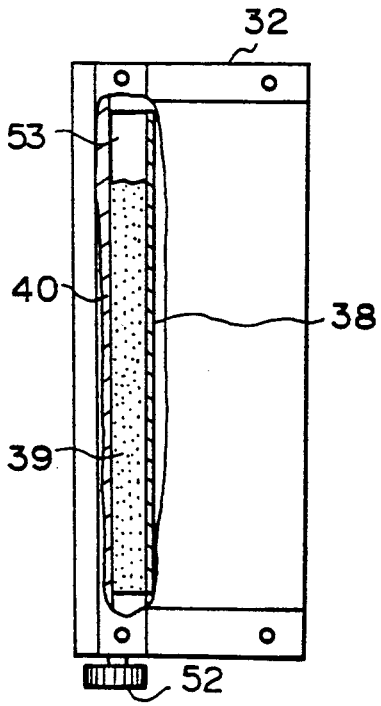
Figure 14B:
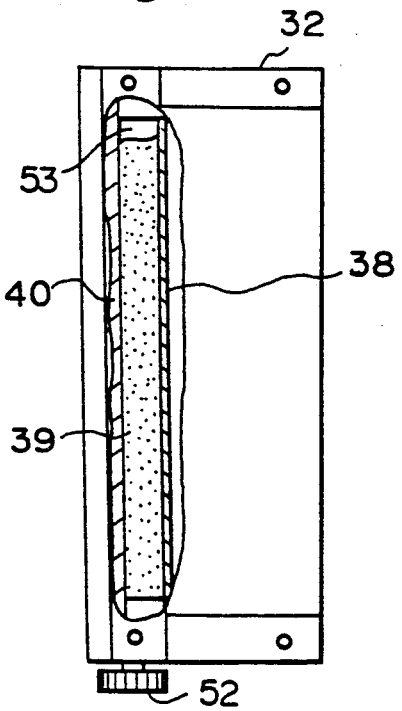

Referring to FIGS. 11*a*–14*b*, FIGS. 11*a* and 11*b* show the case when the amount of the discharged developers 39 is the usual amount, that is 35 g, FIGS. 12*a* and 12*b* show the case when the amount of the discharged developers 39 is 42 g which is 1.2 times the above-described usual amount, FIGS. 13*a* and 13*b* show the case when the amount of the discharged developers 39 is 45.5 g which is 1.3 times the usual amount, and FIGS. 14*a* and 14*b* show the case when the amount of the discharged developers 39 is 49 g which is 1.4 times the usual amount. The developers 39 are simply charged from the developer charger in the case of FIGS. 11*a* and 11*b*, while the developers 39 are charged with vibrating the developing tank 32 in the case of FIGS. 12*a* and 12*b*, 13*a* and 13*b* and 14*a* and 14*b*. The conditions for vibrating the developing tank 32 is arranged taking account of the conditions at the time of the transportation in such a manner that the vibrating frequency is 10 to 55 Hz, the overall amplitude is 2.0 mm, the period of the change in the vibrating frequency is one minute and the duration is 1 hour. In addition, the proper toner density in the developers 39 is arranged to be 30 wt %.

As shown in FIGS. 11*a*–14*b*, the developers 39 in the accommodation unit 51 moves to the movement side of the accommodation unit 51 when the developing tank 32 is vibrated in the above-described conditions, causing space 53 to be formed on the follower side of the accommodation unit 51. The proportion of the space 53 becomes 35.8% in the case of FIG. 11*b*, the proportion of the space 53 becomes *22.6%* in the case of FIG. 12*b*, the proportion of the space 53 becomes 16.0% in the case of FIG. 12*b* and the proportion of the space 53 becomes 5.6% in the case of FIG. 14*b*. As is shown from the drawings, the more the amount of the charged developers 39, the narrower the space 53 in the accommodation unit 51 becomes.

The change in the magnetic toner density when the magnetic toners 33 are injected in the above-described state is shown in Table 1.

TABLE 1

| Quantity of developer charged | Proportion of space | Toner density on the moving side | Toner density on the follower side |
|---|---|---|---|
| 35 g (× 1.0) | 35.8% | 30 wt % | 60 wt % |
| 42 g (× 1.2) | 22.6% | 30 wt % | 53 wt % |
| 45.5 g (× 1.3) | 16.0% | 30 wt % | 40 wt % |
| 49 g (× 1.4) | 5.6% | 30 wt % | 32 wt % |

As can be clearly seen from Table 1, the magnetic toner density becomes different in the axial direction and the toner density on the moving side on which the developers 39 are present is lower than that on the follower side. Furthermore, the more the amount of the charged developers 39, the smaller the difference in the magnetic toner density in the axial direction becomes.

Since the allowable range of the magnetic toner density is 30 to 40 wt % from the point of view of the image quality, the proportion of the space 53 must be made 16% or less after the vibration in order to make the magnetic toner density to be the above-described range. That is, the generation of the difference in the image density can be prevented by making the amount of the charged developers 39 to be 45.5 g or more which is 1.3 times or more of the normal amount.

Furthermore, it has been confirmed that the end portion of the developers 39 reached the end portion of the follower side of the developing tank 32 in the case where the amount of the charged developers 39 is 45.5 g or more when the developing tank 32 is disposed vertically so as to move the developers 39 to either side before changing the attitude of the developing tank 32 to horizontal. If the end portion of the moved developers 39 does not reach the end portion of the follower side of the developing tank 32, the injected toner enters the space. As a result, the toner density on the follower side is raised excessively, causing the density difference to be generated in the image. Therefore, the developers 39 must be charged by 45.5 g or more which is 1.3 times the normal amount.

Then, the developing device is fastened to the copying machine, and the seal member 49 is drawn out from the developing device. Then, the magnetic toners 33 are injected into the toner supply tank 34 in order to supply the magnetic toners 33 to the developing tank 32 by the toner stirring roller 43. The developers 39 (which are stirred and mixed with the magnetic toners 33) are magnetically attracted to the surface of the sleeve 41 of the developing roller 38 in a standing manner. Then, the developers 39 are sent due to the rotation of the sleeve 41 and that of the magnetic body 42 before the amount of the developers 39 is restricted by the doctor 40. Then, the developers 39 are sent to the photoconductor 31 at which the developers 39 are transferred to the photoconductor 31 so that the development is completed.

The developers 39, which are subjected to the developing process but are not transferred to the photoconductor 31, are attracted to the surface of the sleeve 41 before scraping by the scraping part 46. The scraped developers 39 generate the circulating flow A flowing toward the opening 48 due to the rotation of the magnetic body 42.

The magnetic toners 33 are sent to the toner supply port 36 by the toner stirring roller 43 of the toner supply tank 34 so that the magnetic toners 33 are stirred together with the developers 39 by the circulating flow A. As a result, the magnetic toner density becomes a predetermined value.

The developers 39 which are sufficiently stirred by the first stirring unit 47 passes between the scraping part 46 and the sleeve 41 due to the rotation of the sleeve 41 and that of the magnetic body 42 so as to be sent to the doctor 40. A portion of the developers 39 passes between the doctor 40 and the sleeve 41 and the amount of which is restricted before sending to the photoconductor 31. On the other hand, the developers 39, the amount of which is restricted by the doctor 40 and which are scraped off, forms the circulating flow B flowing toward the scraping member 44 before joining the circulating flow A in order to be stirred again.

Therefore, the density of the developers 39 in the accommodation unit 51 can be raised by making the amount of the developers 39 to be charged in the accommodation unit 51 to be 1.3 times the normal amount. As a result, the developers 39 cannot be easily moved, and the space which can be formed in the accommodation unit 51 due to the movement of the developers 39 to either side and due to the falls or vibrations during the transportation, can be reduced. Therefore, the undesired difference in the magnetic toner density in the axial direction can be prevented. Consequently, the difference in the image density can be prevented.

Many widely different embodiments of the present invention may be constructed without departing from the spirit and scope of the present invention. It should be understood that the present invention is not limited to the specific embodiments described in this specification, except as defined in the appended claims.

What is claimed is:

1. A developing device with a scraping unit arranged to form a stirring area, which device is capable of mixing developers with magnetic toners and of providing the developers having a uniform magnetic toner density to a photoconductor for a copying machine, said device having a developing tank which contains a roller composed of a sleeve and a magnetic body with the magnetic body being concentrically disposed inside of the sleeve, the magnetic body and the sleeve being rotatable with respect to each other, said device further having a magnetic toner supply tank disposed adjacent to the developing tank for supplying the magnetic toners to the developing tank through a toner supply port, said developing device comprising:

means coupled to said developing tank for controlling an amount of said developers to be supplied to said sleeve;

means disposed between said toner supply port and said control means, for scraping said developers from said sleeve, said scraping means having a throughhole for causing said scraped developers to be mixed with said magnetic toners supplied from said toner supply tank through said toner supply port in accordance with a magnetic force produced by said magnetic body so as to produce a flow of said developers through said throughhole, said scraping means having a scraping part which is bent in a direction toward said developing roller for scraping said developers from said sleeve, said scraping means being arranged so that a stirring portion is formed in association with said sleeve for stirring said developers scraped from said sleeve and said magnetic toners supplied from said toner supply tank through sad toner supply port, and said scraping means further having end parts and being formed of a predetermined shape with one of the end parts thereof forming said scraping part and the other one of the end parts thereof being bent in parallel with said one of said end parts so as to be fastened to a part of said device.

2. A device according to claim 1, wherein said scraping means is a flat plate having an L-shape cross section.

3. A device according to claim 2, wherein said scraping means is so arranged that another stirring portion is formed between said scraping means and said control means for agitating the developers which are controlled by said control means so that a circulating flow of said developers flows toward said another stirring.

4. A device according to claim 3, wherein said scaping part is positioned in a lower stream from said toner supply port in a rotational direction of said sleeve and close to said control means.

5. A device according to claim 4, wherein a distance d between said scraping part and said control means is so arranged that said distance d is such that $e \leqq d \leqq 1.0$ mm where e represents a distance between said control means and said sleeve.

6. A device according to claim 5, wherein said distance d is in a range of $0.7 \pm 0.1$ mm and the distance e is in a range of $0.30 \pm 0.02$ mm.

7. A device according to claim 1, wherein said device further comprises means disposed between said scraping means and said control means for accommodating said developers to be mixed with said magnetic toners, said accommodating means being capable of accommodating an amount of said developers which is proportional to a normal amount of said developers before using said developing tank, said accommodating means being adapted to accommodate 1.3 times the said normal amount of said developers before using said developing tank.

8. A device according to claim 1, wherein said device further comprises agitating means coupled with said magnetic toner supply tank for stirring said magnetic toner, said agitating means having end parts and a urging means coupled with one of the end parts thereof for pushing said magnetic toner against said developers at said toner supply port so as to mix said magnetic toners with said developers.

9. A device according to claim 8, wherein said agitating means has a crashing means coupled with the other one of the end parts thereof for crashing a solidified part of said developers at said toner supply port.

10. A device according to claim 9, wherein said urging means and said crashing means are capable of applying pressures to said magnetic toners every half revolution of said agitating means so that said magnetic toners are supplied under pressure and in a wave-like manner to said toner supply port.

11. A device according to claim 8, wherein said agitating means has a support plate and body of said device has a roller shaft rotatably supported by said body of said device, said support plate being fixed to said roller shaft.

12. A device according to claim 11, wherein said support plate has end parts and one of the end parts of said support plate is adapted to fasten said urging means in a direction perpendicular to said support plate so as to supply said magnetic toners in elastic contact with a bottom surface of said developing tank.

13. A device according to claim 12, wherein the other one of the end parts of said support plate is adapted to fasten a crashing means, said crashing means including a coil spring fixed to two end parts of said roller shaft and disposed in parallel to said roller shaft so as to prevent said magnetic toners from being solidified by vibrating said magnetic toners.

14. A device according to claim 1, wherein said device further comprises means disposed between said scraping means and said control means for accommodating said developers to be mixed with said magnetic toners, said accommodating means being capable of accommodating an amount of said developers which is 1.3 times of a normal amount of said developers before using said developing tank.

15. A developing device with a scraping unit arranged to form a stirring area, which device is capable of mixing developers with magnetic toners and of providin the developers having a uniform magnetic toner density to a photoconductor for a copying machine, said device having a developing tank which contains a roller composed of a sleeve and a magnetic body with the magnetic body being concentrically disposed inside of the sleeve, the magnetic body and the sleeve being rotatable with respect to each other, said device also having a magnetic toner supply tank disposed adjacent to the developing tank for supplying the magnetic toners to the developing tank through a toner supply port, said developing device comprising:

means coupled to said developing tank for controlling an amount of said developers to be supplied to said sleeve;

means disposed between said toner supply port and said control means for scraping said developers from said sleeve, said scraping means being so arranged that a stirring portion is formed in association with said sleeve for stirring said developers scraped from said sleeve and said magnetic toners being supplied from said toner supply tank through said toner supply port, said scraping means having a throughhole for causing said scraped developers to be mixed with said magnetic toners supplied from said toner supply tank through said toner supply port in accordance with a magnetic force produced by said magnetic body so as to produce a flow of said developers through said throughhole, said scraping means being a flat plate having an L-shape cross section with one of the end part of said flat plate being a scraping part which is bent in a direction toward said developing roller for scraping said developers from said sleeve, the other one of said end parts of said flat plate being bent in parallel with said one of the end parts so as to be fastened to a part of said device disposed below said toner supply port.

16. A developing device with a scraping unit arranged to form a stirring area, which device is capable of mixing developers with magnetic toners and of providing the developers having a uniform magnetic toner density to a photoconductor for a copying machine, said device having a developing tank which contains a roller composed of a sleeve and a magnetic body with the magnetic body being concentrically disposed inside of the sleeve, the magnetic body and the sleeve being rotatable with respect to each other, said device also having a magnetic toner supply tank disposed adjacent to the developing tank for supplying the magnetic toners to the developing tank through a toner supply port, said developing device comprising:

means coupled to said developing tank for controlling an amount of said developers to be supplied to said sleeve;

means disposed between said toner supply port and said control means for scraping said developers from said sleeve, said scraping means being so arranged that a stirring portion is formed in association with said sleeve for stirring said developers scraped from said sleeve and said magnetic toners being supplied from said toner supply tank through said toner supply port; and means disposed between said scraping means and said control means for accommodating said developers to be mixed with said magnetic toners, said accommodating means being capable of accommodating an amount of said developers which is 1.3 times of a normal amount of said developers before using said developing tank.

* * * * *